US006149097A

United States Patent [19]

Ludwig et al.

[11] Patent Number: 6,149,097

[45] Date of Patent: Nov. 21, 2000

[54] WINDING APPARATUS FOR ENDLESS THREADS

[75] Inventors: Adrian Ludwig; Roland Schenk, both of Winterthur, Switzerland

[73] Assignee: Maschinenfabrik Rieter AG, Winterthur, Switzerland

[21] Appl. No.: 09/217,282

[22] Filed: Dec. 21, 1998

[30] Foreign Application Priority Data

Jan. 23, 1998 [DE] Germany ..... 198 02 509

[51] Int. Cl.[7] ..... B65H 54/22

[52] U.S. Cl. ..... 242/474.5; 242/474.6; 242/486

[58] Field of Search ..... 242/474.5, 474.6, 242/486

[56] References Cited

U.S. PATENT DOCUMENTS

| | | | |
|---|---|---|---|
| 3,913,852 | 10/1975 | Lenk et al. | 242/474.6 |
| 4,084,760 | 4/1978 | Nakano et al. | 242/474.6 |
| 4,298,171 | 11/1981 | Fluckiger et al. | 242/474.6 |
| 4,431,138 | 2/1984 | Schiminski et al. | 242/474.6 |
| 4,487,374 | 12/1984 | Sugioka et al. . | |
| 4,552,313 | 11/1985 | Sasaki | 242/474.6 |
| 4,602,747 | 7/1986 | Turk et al. | 242/474.6 |
| 4,765,552 | 8/1988 | Sugioka et al. . | |
| 5,016,829 | 5/1991 | Schippers et al. | 242/474.6 |
| 5,100,072 | 3/1992 | Behrens et al. . | |
| 5,308,004 | 5/1994 | Ukai et al. | 242/474.6 |
| 5,407,143 | 4/1995 | Nakai et al. . | |
| 5,558,286 | 9/1996 | Sugioka et al. . | |
| 5,566,904 | 10/1996 | Hashimoto | 242/474.5 |
| 5,797,551 | 8/1998 | Wirz et al. . | |
| 5,816,513 | 10/1998 | Spahlinger | 242/474.5 |

FOREIGN PATENT DOCUMENTS

| | | |
|---|---|---|
| 0015410 | 9/1980 | European Pat. Off. . |
| 1247112 | 8/1967 | Germany . |
| 2459990 | 6/1975 | Germany . |
| 7820682 | 11/1978 | Germany . |
| 2048416C3 | 11/1982 | Germany . |
| 4321111A1 | 1/1994 | Germany . |
| 4423491A1 | 1/1996 | Germany . |
| 19538480C1 | 5/1997 | Germany . |
| 29706350U1 | 7/1997 | Germany . |
| 8916288U1 | 7/1997 | Germany . |

OTHER PUBLICATIONS

German Search Report, Jul. 17, 1998.
Patent Abstracts of Japan, Oct. 17, 1995.

*Primary Examiner*—Donald P. Walsh
*Assistant Examiner*—Minh-Chau Pham
*Attorney, Agent, or Firm*—Dority & Manning

[57] ABSTRACT

In a winding apparatus for endless threads, a revolving disc (6) has at least two clamping chucks (8, 10) rotatably supported on the periphery thereof. A friction roll (2), the shaft (4) of which as well as the shaft (12) of the revolving disc (6) are mounted in a frame (14) at fixed locations. The shaft (12) is connected to a first drive device (120) and the first shaft (4) is connected to a second drive device (40). Each clamping chuck (8, 10) is provided with its own third drive device (80), and fourth drive device (100) respectively.

15 Claims, 2 Drawing Sheets

WINDING APPARATUS FOR ENDLESS THREADS

BACKGROUND

The present invention concerns a winding apparatus for endless threads and an operating method for such a winding apparatus. The invention relates particularly to a winding apparatus utilizing a revolving disc having at least two clamping chucks rotatably supported on the periphery thereof.

From the Swiss Patent 624 910 a winding apparatus of this type is known in which a chuck for taking up a package tube and thus of a thread or yarn package can be driven indirectly i.e. via a friction roll or an accelerating ring.

Due to the increase in production rates of winding machines, or winding aggregates respectively, frictional power transmission between various rotating elements no longer meets the requirements.

OBJECTS AND SUMMARY OF THE INVENTION

It thus is a principal objective of the present invention to further improve the development of a winding apparatus in such a manner that disturbance-free operation as well as higher production rates, i.e. higher rotational speeds of the winding apparatus are rendered feasible. Additional objects and advatages of the invention will be set forth in part in the following description or may be obvious from the description, or may be learned through practice of the invention.

The objects are met using a winding apparatus with the characteristics according to the appended claims. The method claims define processing steps using which the quality of the thread produced and the economic feasibility are improved.

A winding apparatus for endless threads is proposed with a revolving disc in the periphery of which at least two clamping chucks are rotatably supported, and with a friction roll the shaft of which as well as another shaft of the revolving disc are mounted in a frame in which arrangement the other shaft is connected to a first drive device and the first mentioned shaft is connected with a second drive device, and where each clamping chuck is provided with its own third drive device, and with a fourth drive device respectively. At least one of the drive devices mentioned consists of a programme-controlled inverter and an electric motor supplied with current by this inverter. The clamping chucks can be supported on the revolving disc using a pivoting arm each or can be mounted directly onto the revolving disc. Each clamping chuck is pivotably mounted on the revolving disc using a pivoting drive device if pivoting arms are provided. The clamping chucks can be pivoted on the revolving disc using setting motors. In the zone of the friction roll, at least a thread string-up device, a thread traversing device, a shifting device and/or a thread lifting device are supported. For the friction roll, an auxiliary drive device can be provided which engages the circumference, and in particular its shaft. To the thread traversing device, preferentially a control device is coordinated which contains a programme module for generating a stepped precision winding structure. For activating a shifting device, a double action cylinder can be used. The shaft of the friction roll and the other shaft of the revolving disc, or more generally, of the rotatable support, can be arranged at a fixed location.

To a second drive device, of the friction roll and to a third drive device, and to a fourth drive device respectively, a common control device is configured. Preferentially the load distribution between the second drive device and the third or the fourth drive device can be varied according to a programme. Furthermore the drive devices mentioned must be controlled as to their rotational speeds in such a manner that the respective circumferential speeds of the friction roll and of a thread package placed on a clamping chuck do not differ noticeably.

In the winding zone of a clamping chuck, an entangling see-saw device comprising a spring and an air nozzle can be provided which can be pressed against a thread package in which arrangement the air nozzle in this zone serves for delaying the formation of a bulge on the thread package. In the frame of the winding apparatus, a thread package lifting device is provided which facilitates the exchange, and the removal respectively, of the completed packages. Preferentially, a blocking device acting on the thread package lifting device is activated during certain operating phases. On the thread string-up device, according to the requirements, a severing device with a severing protrusion for thread ends can be mounted. For the thread traversing device, a lubrication system can be provided. As the main control device of the winding apparatus is switched on, preferentially at least a third drive device or a fourth drive device of the corresponding clamping chuck is switched on also in such a manner that after operation of a thread string-up device upon the start-up of the machine, the thread can be transferred without delay onto a package tube on a clamping chuck.

Owing to the individual drive devices for the friction roll, or contacting roll respectively, the thread is treated particularly gently during the change from one thread package to the subsequent package tube in such a manner that no relative movements between the thread and the surfaces of the thread packages, and the rolls respectively, are incurred.

The drive devices on one hand for shifting the clamping chucks relative to the revolving disc, or to the revolver respectively, and on the other hand for the revolver permit that the thread package exchange process can be effected independently of the winding start-up of a new thread package, or vice versa respectively.

The present invention is described in more detail in the following with reference to embodiments illustrated in schematic drawings.

DETAILED DESCRIPTION

Figure 1:
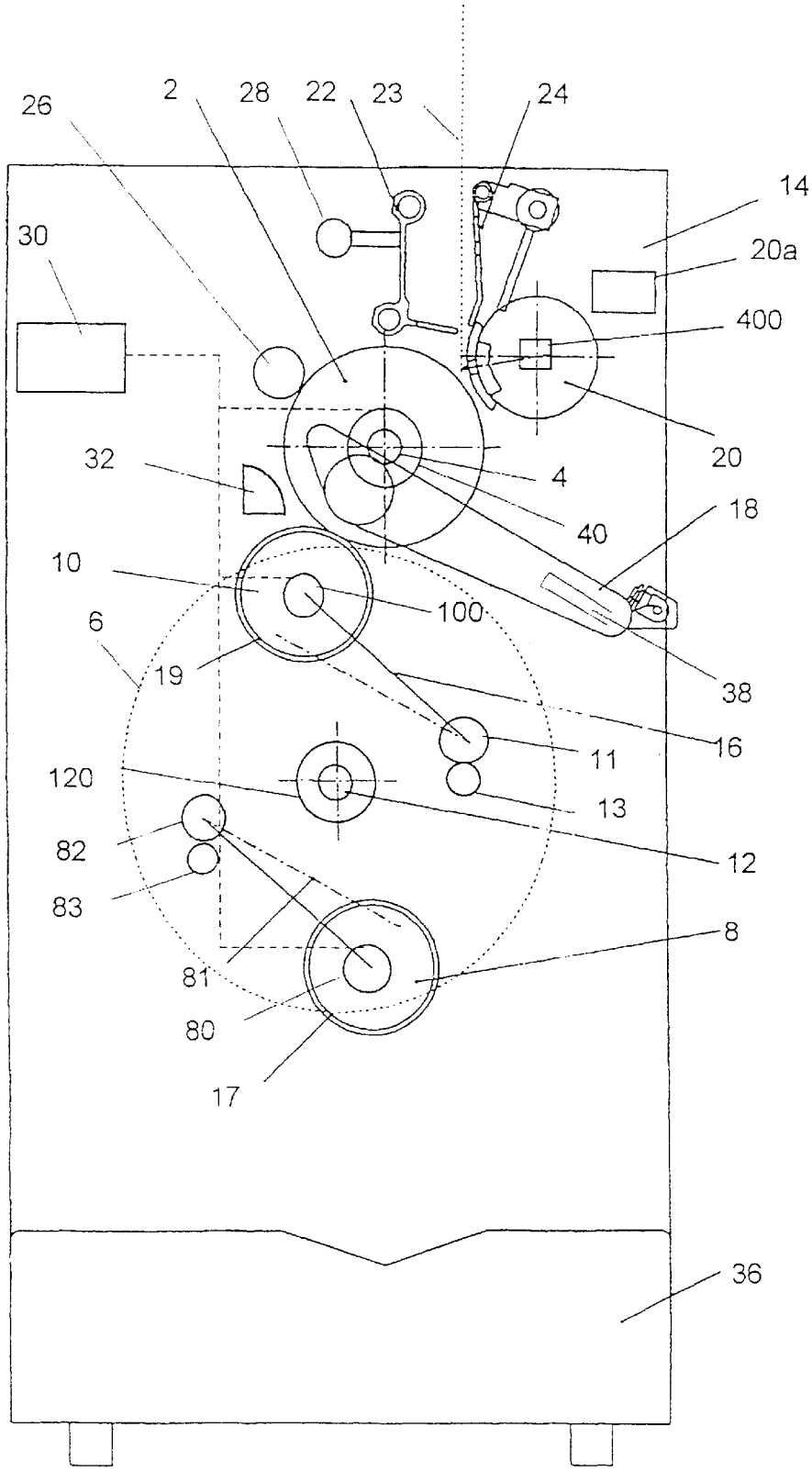
FIG. 1 An overall view of the most important components of the apparatus, and in FIG. 2 A control device for the contacting pressure between a clamping chuck and the friction roll.

Reference will now be made in detail to the present preferred embodiments of the invention, one or more examples of where shown in the drawings. Each example is provided by way of explanation of the invention, and not as limitation of the invention. Features described or illustrated as part of one embodiment can be used with another embodiment to yield still a further embodiment. It is intended that the present invention include such a modifications and variations.

A thread 23 is supplied from above into the zone of the frame 14 of a spinning device between a shifting device 22 and a thread traversing device 20 on which a thread lifting device 24 can be arranged. The thread 23, indicated with broken lines, upon leaving the thread traversing device 20 is deflected about the lower right hand portion of the circumference of a friction roll 2 into the direction towards a clamping chuck 10 on which a package tube 19 is placed. At the start of a winding cycle, i.e. as a freshly spun or a treated thread 23 is supplied, a thread string-up device is activated which above the frame 14 takes over the thread 23 and places it onto the circumference of a package tube 19.

In addition to a first clamping chuck 10 on which the package tube 19 is placed a second clamping chuck 8 with a package tube 17 is provided, both chucks being supported on a revolving disc 6, or revolver, which via a shaft 12 is connected to a first drive device 120. The revolving disc 6 and the first drive device 120 are in motion during the exchange of the positions of the first clamping chuck 10 and of the second clamping chuck 8, and during a part of a winding cycle. The clamping chucks 10 and 8 can be rotatably supported directly on the revolving disc 6 or can be pivotably mounted onto the revolving disc 6 via pivoting arms 81, and 16 respectively.

As soon as the thread 23 is attached to the package tube 19, the winding cycle can be started. For driving the friction roll 2, also called tacho roll, a shaft 4 with a second drive 40 device is used. For driving the clamping chuck 8, and 10 respectively, a third drive device 80, and a fourth drive device 100 respectively, are mounted to the revolving disc 6. If pivoting arms 1, and 16 respectively, are used, a pivoting drive device 82 with a setting motor 83, and a second pivoting drive device 11 with a setting motor 13 respectively, are required.

For driving rotating rolls such as, e.g. the clamping chuck 8 or the friction roll 2, preferentially asynchronous motors are applied which in particular are supplied with current by inverters at adjustable output frequencies. The other setting motors, e.g. the first drive device 120 for rotating the revolving disc 6 or the setting motors 83, and 13 respectively, can be laid out as mechanical or pneumatic or electromechanical setting motors.

In the lower part of the frame 14, a thread package lifting device 36 is arranged using which completed thread packages pivoted downward can be removed with the corresponding package tubes 17, and 19 respectively, from the winding apparatus.

To the thread traversing device. 20 a control device 20*a* can be coordinated which comprises a programme module for generating a stepped precision winding structure. A double action cylinder 28 can be provided for activating a shifting device 22. To a second drive device 40 of the friction roll 2 and to a third drive device 80 of a clamping chuck 8, as well as to a fourth drive device 100 of the clamping chuck 10, a common main control device is superordinated, as indicated in the FIG. 1, using which arrangement the load distribution between the second drive device 40 and the third drive device 80 or the fourth drive device 100 can be varied according to a programme.

In the winding zone of a clamping chuck 8 or 10, an entangling see-saw device 32 (shown schematically) can be pressed against a thread package placed on a clamping chuck 8 or 10, and furthermore an air nozzle (not shown) can be provided for delaying the formation of an end bulge in this zone. In the frame 14 a blocking device can be coordinated to the thread package lifting device 36. On the thread string-up device 18, as shown schematically, a thread severing device 38 can be applied. The thread traversing device 20 advantageously is provided with a lubricating system 400.

Figure 2:
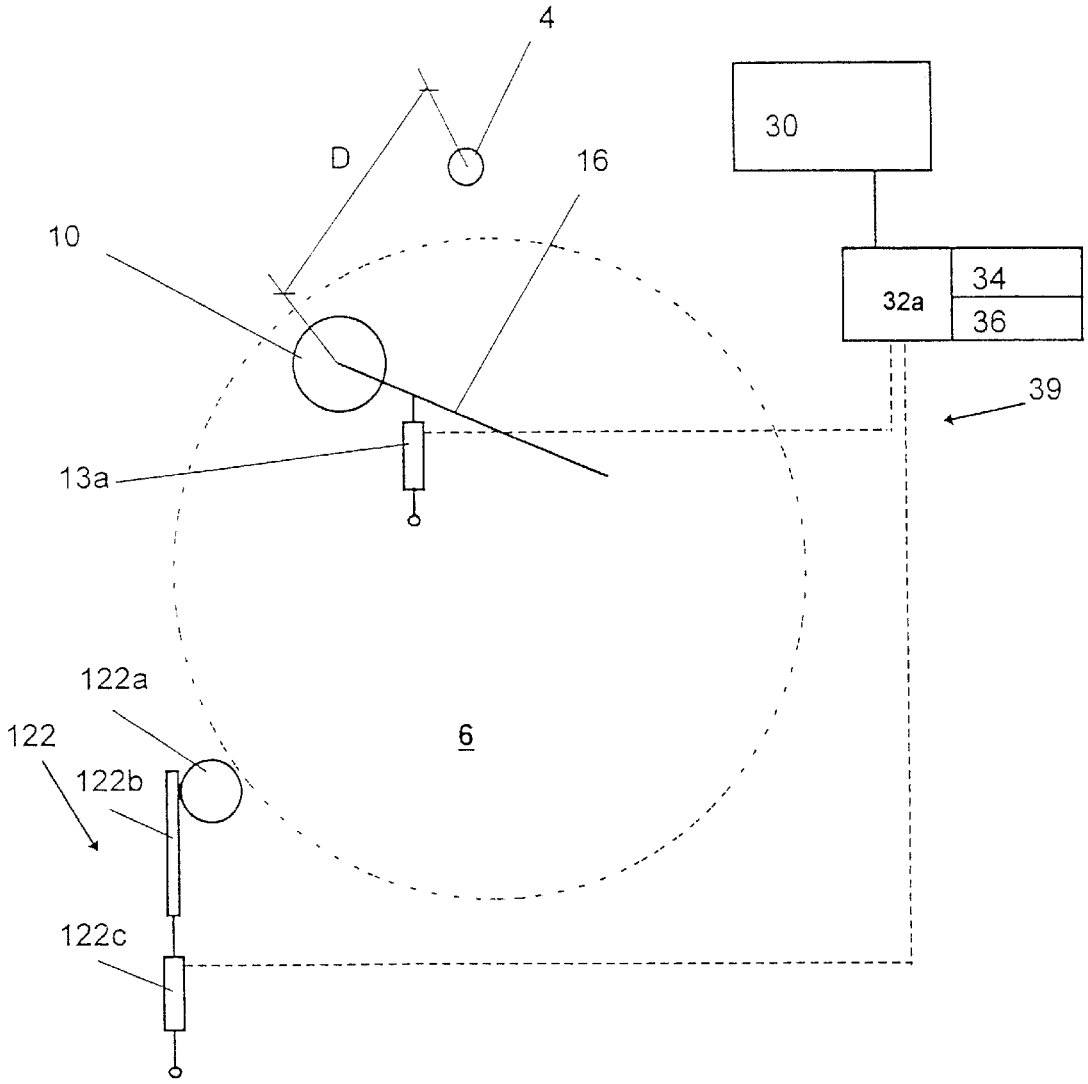

To maintain constant, or to vary, the contacting pressure between the friction roll 2 and the respective thread package, the axle distance, of which in the FIG. 2 is designated D, presents a particular problem. After the revolving disc 6 is rotated over 180° upon completion of a thread package, the respective subsequent clamping chuck with the package tube 19 placed thereon is wound onto with a thread 23, or a plurality of threads respectively, in a new winding cycle. It has proven advantageous that during the build-up of a new thread package on a clamping chuck 8, the contacting pressure between the thread layers on the chuck and the friction roll 2, or tacho roll, be controlled. It can be rendered feasible to maintain the contacting pressure constant, or to vary it according to a predetermined programme. This is achieved in that the clamping chuck 10 is pressed against the friction roll 2 by a pressing device. This can be effected in that a clockwise torque momentum is exerted onto the revolving disc 6, or if the revolving disc 6 is blocked, the clamping chuck 10, which in this case must be supported shiftable relative to the revolving disc 6, is pressed against the friction roll 2, or tacho roll, by another pressing device arranged between the revolving disc 6 and a pivoting arm 16, 81. For the friction roll 2, an auxiliary drive device 26 can be provided.

In a preferred embodiment of this type, the winding apparatus for endless threads according to the FIG. 2 is provided with a programme controlled pressing mechanism which may be formed from a combination of elements including 30, 32, 34, 36, 13*a*, 122, for generating a contacting pressure between a friction roll 2 and a clamping chuck 8, 10 which is equipped with a control module 32 connected to at least one data storage device 34, 36 and connected via control circuits 39 with a pressing device 122,13*a* which is laid out to exert a torque momentum onto the revolving disc 6, in which arrangement in the control module 32*a* means are provided using which, based on data taken from one of the data storage devices 34, 36, via the control circuits 39 in the pressing device 122,13*a* variable contacting pressure conditions between a clamping chuck and a friction roll 2 can be generated as a function of the diameter of the thread package being built up on a clamping chuck 8, 10.

The pressing mechanism can be subdivided into a first pressing device 13*a* acting on a clamping chuck 8, 10 shiftably supported on the revolving disc 6 and/or into a second pressing device 122 acting onto the revolving disc 6.

The pressing devices 122, 13*a* may be provided with load limited setting motors in particular pneumatic cylinders such as 122*c*.

The pressing device 13*a*, 122 is laid out to act onto a pivoting arm 16 of a clamping chuck 10 and/or directly onto the revolving disc 6 in which case a setting motor 122*c* is connected to the revolving disc via a rack 122*b* and a pinion 122*a*.

It should be apparent to those skilled in the art that various modifications and variations can be made in the present invention without departing from the scope and spirit of the invention. It is intended that the present invention include such modifications and variations as come within the scope of the appended claims and their equivalents.

List of Elements shown in the Figures

2 friction roll (tacho roll)
4 shaft
6 revolving disc
8 second clamping chuck
10 clamping chuck

11 pivoting drive device
12 shaft
13 setting motor
14 frame
16 pivoting arm
17 package tube
18 thread string-up device
19 package tube
20 thread traversing device
20*a*
21
22 shifting device
23 thread
24 thread lifting device
26 auxiliary drive device
30
32*a*
36 thread package lifting device
38 thread severing device
40 second drive device
80 third drive device
81 second pivoting arm
40,82 pivoting drive device
83 setting motor
100 fourth drive device
120 first drive device
122*a* pinion
122*b* rack
122*c* setting motor
400 lubricating system for the thread traversing device

What is claim is:

1. A winding apparatus for winding endless threads, comprising:

a revolving disc having a disc shaft mounted at a fixed location within a machine frame, said disc shaft connected to a first drive device;

at least two clamping chucks rotatably supported on a periphery of said revolving disc;

a friction roll having a friction roll shaft mounted at a fixed location within said machine frame, said friction roll shaft connected to a second drive device;

each of said clamping chucks connected to their own respective drive devices; and wherein each of said clamping chucks is supported on said revolving disc by a pivoting arm connected to a pivoting drive device; and wherein at least one of said first drive device, second drive device, and clamping chuck drive devices comprises an electric motor supplied with current by a program controlled inverter.

2. A winding apparatus for winding endless threads, comprising:

a revolving disc having a disc shaft mounted at a fixed location within a machine frame, said disc shaft connected to a first drive device;

at least two clamping chucks rotatably supported on a periphery of said revolving disc;

a friction roll having a friction roll shaft mounted at a fixed location within said machine frame, said friction roll shaft connected to a second drive device;

each of said clamping chucks connected to their own respective drive devices; and wherein each of said clamping chucks is supported on said revolving disc by a pivoting arm connected to a pivoting drive device; and wherein said pivoting drive devices comprise setting motors.

3. A winding apparatus for winding endless threads, comprising:

a revolving disc having a disc shaft mounted at a fixed location within a machine frame, said disc shaft connected to a first drive device;

at least two clamping chucks rotatably supported on a periphery of said revolving disc;

a friction roll having a friction roll shaft mounted at a fixed location within said machine frame, said friction roll shaft connected to a second drive device;

each of said clamping chucks connected to their own respective drive devices; and wherein each of said clamping chucks is supported on said revolving disc by a pivoting arm connected to a pivoting drive device; and further comprising an auxiliary drive device connected to said friction roll shaft.

4. The winding apparatus as in claim 1, further comprising a thread traversing device disposed proximate to said friction roll, said thread traversing device connected to a program control device for generating a stepped winding structure.

5. The winding apparatus as in claim 1, further comprising a shifting device disposed proximate to said fiction roll, said shifting device connected to a double acting cylinder for adjustment thereof.

6. A winding apparatus for winding endless threads, comprising:

a revolving disc having a disc shaft mounted at a fixed location within a machine frame, said disc shaft connected to a first drive device;

at least two clamping chucks rotatably supported on a periphery of said revolving disc;

a friction roll having a friction roll shaft mounted at a fixed location within said machine frame, said friction roll shaft connected to a second drive device;

each of said clamping chucks connected to their own respective drive devices; and wherein each of said clamping chucks is supported on said revolving disc by a pivoting arm connected to a pivoting drive device; and wherein said second drive device and said clamping chuck drive devices are connected to a common main control device such that load distribution therebetween can be varied by said common main control device.

7. A winding apparatus for winding endless threads, comprising:

a revolving disc having a disc shaft mounted at a fixed location within a machine frame, said disc shaft connected to a first drive device;

at least two clamping chucks rotatably supported on a periphery of said revolving disc;

a friction roll having a friction roll shaft mounted at a fixed location within said machine frame, said friction roll shaft connected to a second drive device;

each of said clamping chucks connected to their own respective drive devices; and p1 wherein each of said clamping chucks is supported on said revolving disc by a pivoting arm connected to a pivoting drive device; and further comprising an entangling device operably disposed in a winding zone proximate said friction roll, said entangling device biased so as to press against a thread package placed on one of said clamping chucks.

8. The winding device as in claim 1, further comprising a thread package lifting device.

9. The winding device as in claim 1, further comprising a thread string-up device configured with a thread severing device.

10. The winding device as in claim 1, further comprising a thread traversing device disposed proximate to said friction roll, and a lubricating system operably configured with said thread traversing device.

11. The winding device as in claim 1, further comprising a pressing device disposed for pressing one of said clamping chucks against said friction roller.

12. A winding apparatus for winding endless threads, comprising:

a revolving disc having a disc shaft mounted at a fixed location within a machine frame, said disc shaft connected to a first drive device;

at least two clamping chucks rotatable supported on a periphery of said revolving disc;

a friction roll having a friction roll shaft mounted at a fixed location within said machine frame, said friction roll shaft connected to a second drive device;

each of said clamping chucks connected to their own respective drive devices; and wherein each of said clamping chucks is supported on said revolving disc by a pivoting arm connected to a pivoting drive device;

a pressing device disposed for pressing one of said clamping chucks against said friction roller; and wherein said pressing device comprises one of a first pressing device acting on said clamping chuck and a second pressing device acting on said revolving disc.

13. The winding device as in claim 12, wherein said first and second pressing devices are configured with load limited setting motors.

14. The winding device as in claim 12, wherein said first pressing device is configured to act on a pivoting arm of said clamping chuck and said second pressing device is configured to act on and impart a torque to said revolving disc.

15. The winding device as in claim 14, wherein said second pressing device comprises a rack and pinion device.

* * * * *